US007173641B2

(12) United States Patent
Pasch et al.

(10) Patent No.: US 7,173,641 B2
(45) Date of Patent: Feb. 6, 2007

(54) ELECTROSTATIC PRINTERS USING MICRO ELECTRO-MECHANICAL SWITCHING ELEMENTS

(76) Inventors: Nicholas F. Pasch, 1470 De Solo Dr., Pacifica, CA (US) 94044; Glenn C. Sanders, 201 Ada Ave., #28, Mountain View, CA (US) 94043

( * ) Notice: Subject to any disclaimer, the term of this patent is extended or adjusted under 35 U.S.C. 154(b) by 126 days.

(21) Appl. No.: 11/019,506

(22) Filed: Dec. 20, 2004

(65) Prior Publication Data

US 2005/0134644 A1 Jun. 23, 2005

Related U.S. Application Data

(60) Provisional application No. 60/532,234, filed on Dec. 22, 2003.

(51) Int. Cl.
*B41J 2/005* (2006.01)
*G03G 15/00* (2006.01)
*G03G 15/01* (2006.01)

(52) U.S. Cl. ..... 347/112; 347/141; 358/1.7; 358/1.8

(58) Field of Classification Search ..... 347/54, 347/112, 141, 142, 147; 358/1.7, 1.8
See application file for complete search history.

(56) References Cited

U.S. PATENT DOCUMENTS

2002/0180857 A1* 12/2002 Silverbrook ..... 347/112

* cited by examiner

*Primary Examiner*—Huan Tran

(57) ABSTRACT

The present invention relates to a printer system that incorporates an electrically addressable array of micro electro-mechanical switches of arbitrary width. In one embodiment, array of micro electro-mechanical switches of arbitrary width that comprises an electrostatic array used to attract fusible toner or electrically charged ink droplets from a hopper or ink jet assembly to a piece of paper or other printable substrate. The electrostatic array uses electrostatic latching to create the charged environment to allow the toner or ink to be attracted from the hopper or ink jet assembly toward the array. A piece of paper is interposed between the array and the hopper or ink jet assembly. Additional micro electro-mechanical switches control the release of the ink droplets from the ink jet assembly. The micro electro-mechanical switches each comprise a sealed cell that relies on pneumatic restoration forces to insure that switch contacts can be successfully broken as desired.

20 Claims, 4 Drawing Sheets

ELECTROSTATIC PRINTERS USING MICRO ELECTRO-MECHANICAL SWITCHING ELEMENTS

CROSS-REFERENCE TO RELATED APPLICATIONS

This application claims priority from provisional U.S. patent applications entitled "On the use of electro-mechanical switching elements to create a electrostatic printer technology" U.S. application No. 60/532,234, filed Dec. 22, 2003 and "On the use of pneumatic and elastic restoration of membrane switches used for display backplanes and other applications" U.S. application No. 60/532,026, filed Dec. 22, 2003, the entire disclosures of which are herein incorporated by reference.

BACKGROUND OF THE INVENTION

1. Field of the Invention

The present invention relates to printers and more particularly to improved printers that use micro electro-mechanical switches to decrease cost and improve performance.

2. Description of the Background Art

Two common types of printers in wide use are the laser printer and the ink jet printer that are designed for both home and office. The laser printer is a well-known and commercially successful type of indelible printer. It utilizes static electricity to build up an electrical charge on a photoreceptor made out of highly photoconductive material. This material looses a charge when activated by light photons from the laser. Since the laser draws the image of the page onto the photoreceptor, a scanning assembly is needed to scan the laser across the photoreceptor and this assembly must be incredibly precise.

The typical laser scanning assembly includes a laser, a movable mirror and lens, all of which are expensive. The laser is modulated to print tiny dots that make up the image to be printed one horizontal line at a time. As the laser beam moves across the photoreceptor, the laser emits a pulse of light for every dot to be printed, and no pulse where a dot is not to be printed. Because the laser doesn't actually move the beam itself, the laser beam is bounced off of the moveable mirror. As the mirror moves, it shines the laser beam through a series of lenses that compensate for image distortion caused by the varying distance between the mirror and dots along the photoreceptor. In a laser printer, the mirror spins incredibly quickly and is synchronized with the laser switching on and off. A typical laser printer will switch millions of times every second.

The charged photoreceptor attracts electrically charged toner in the shape of the image that is then transferred onto a sheet of paper. The sheet of paper is then heated to fuse the toner to the paper. The laser printer is typically preferred for business applications because the printed image is indelible which means that it will not smear, smudge and is generally of archival quality.

A major disadvantage of the laser printer is the cost of the components and specifically the cost of the laser, the laser scanning system and the photoreceptor. Not only are these components expensive, they are also subject to wearing out and the photosensitive drum requires regular replacement. Further, the process of getting the image from the computer to the paper requires sophisticated control software and electronics, optics, mechanics and chemistry. Because of high cost components and system complexity, laser printers are relatively expensive so what is needed is a simple, indelible printer that does not require expensive components such as the laser, scanning optic or a photoreceptor.

Another type of commonly used printer is the ink jet printer. Ink jet printers are relatively inexpensive compared to laser printers because they use charged particles or ink rather than toner. Ink jet printers work on the principle that a printing head by means of several physical principles, e.g., heat, ultrasonic pulse, etc., is made to eject a small ink droplet onto an absorbent paper. The droplets form the desired graphical image. Ink jet printers produce different colors by mixing at least cyan, magenta, and yellow inks and can accurately create an extremely large range of colors. Ink jet printers are often used to print digital photographs. The major disadvantage of the ink jet printer is that the printed image tends to fade rather quickly, often in as little as three to six months. The image is not moisture-fast, and images with significant quantities of deposited ink are often wrinkled by the moisture. It is clearly desirable to provide a low cost indelible color printer.

With respect to ink jet printers, conservation of ink is clearly desirable. For this reason many ink jet printers utilize drop on demand technology where a ink drop is generated only when needed. Many other ink jet printers generate a continuous stream of ink that relies on the deflection of drops that are to be applied to the paper. The non-deflected drops are collected and recycled. However, recycling ink drops can introduce air to the ink reservoir and is generally undesirable. The drop on demand technology utilizes piezo-electrical crystals that change their dimensions when an electrical current is applied to generate a drop. Such crystals are expensive so a lower cost alternative to generate a drop of ink is necessary.

Another disadvantage of current printers is that lack of a low cost printer that can print on paper that is wider than about twelve inches. It would be advantageous if a printer could print on paper having a width that exceeds twelve inches.

SUMMARY OF THE INVENTION

Embodiments of the present invention provide a matrix of micro electro-mechanical switches that can be used in various printer applications. More specifically, the switches can be used in an indelible printer to attract charged toner material in a useful pattern and release said toner as required. This technology and process can provide a significant improvement in printer systems.

In one embodiment, the micro electro-mechanical switches replace the laser, laser scanning system, and the photoreceptor in an indelible printer with low cost plastic switches. Since the cost of construction of the matrix of micro electro-mechanical switches is a small fraction of the cost of construction of a laser scanner system, it will be appreciated that this results in a significant cost reduction. Further, the matrix of micro electro-mechanical switches provide a significant improvement in lifetime over that of the photosensistve printing drum and the reduction in operating costs is substantial.

In another embodiment, one or more switches replace the piezo-electric crystal in a drop on demand ink jet printer. When the switch is in the ON state, ink is drawn into the chamber. When a drop is to be expelled from the chamber, the switch is changed to the OFF state. The change in volume generates a shock wave that expels the ink droplet.

The interior volume of each switch may be packed with an incompressible material to increase the force that causes the switch contacts to break. Because of the well-known phenomenon of the stiction of switch contacts in use, it is necessary to insure that the retraction force is greater than the make contact force.

The foregoing and additional features and advantages of this invention will become apparent from the detailed description and review of the associated drawing figures that follow.

DETAILED DESCRIPTION OF THE INVENTION

In the description herein for embodiments of the present invention, numerous specific details are provided, such as examples of components and/or methods, to provide a thorough understanding of embodiments of the present invention. One skilled in the relevant art will recognize, however, that an embodiment of the invention can be practiced without one or more of the specific details, or with other apparatus, systems, assemblies, methods, components, materials, parts, and/or the like. In other instances, well-known structures, materials, or operations are not specifically shown or described in detail to avoid obscuring aspects of embodiments of the present invention.

Figure 1:
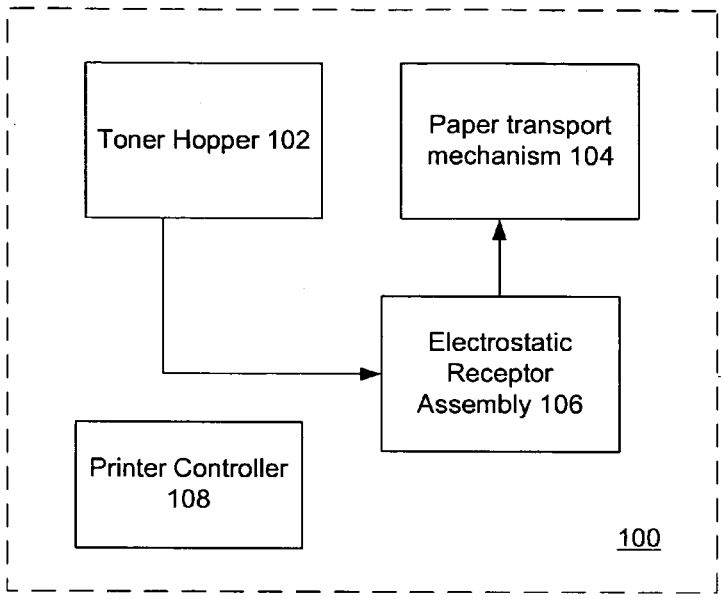
FIG. 1 is a block diagram of an exemplary indelible printer system incorporating a micro-electromechanical switch in accordance with an embodiment of the present invention.

Referring now to the drawings more particularly by reference numbers, a simplified block diagram of a printer 100 in accordance with one embodiment of the present invention is shown in FIG. 1. Printer 100 comprises a toner hopper 102 that contains fusible toner material. The chemical composition of the powdery toner material is well known in the art and is not further described other than to note that the toner material carries an electrostatic charge. A paper transport mechanism 104 carries a sheet of paper past an electrostatic receptor assembly 106. Transport mechanism 104 typically comprises a set of rubber rollers that transfers a sheet of paper from an input bin to a position where it may make contact with receptor assembly 106 and then on to an output tray.

Receptor assembly 106 contains a plurality micro electro-mechanical switches each of which define a charged electrostatic region. As receptor assembly 106 rotates past hopper 102, charged toner is attracted to the oppositely charged regions of receptor assembly 106. The toner material is then deposited onto the paper, which has a stronger electrostatic charge than receptor assembly 106. Advantageously, printer 100 does not require a scanning laser unit with expensive optical components such as a scanning mirror or lenses or a photoreceptor assembly.

Printer controller 108 may include a RISC processor or other suitable computer and memory and is responsible for controlling operation of printer 100. In other embodiments, controller 108 consists merely of a printer memory with the image to be printed determined by a host computer. Controller 108 receives a page description from another source, such as from a computer file system, from a display screen or from a network connection, and generates the necessary image pattern on receptor assembly 106. The page description typically consists of vector information of the entire image to be printed on a page of paper. This allows controller 108 to use basic geometric principles to determine how to best create the image on paper. Where the image to be printed is communicated to it via a page description language, controller 108 converts the description into a bitmap. This result is an image (in memory) of every dot that will be placed on the paper.

Resolution of printer 100 is determined by electrostatic receptor assembly 106, which has a plurality of micro electro-mechanical switches with each switch controlling the charge assigned to a picture element or dot on the sheet of paper. Since a sheet of A4 size paper is 8.5 in across and 11 in deep, receptor assembly 106 can have more than eight million dots at 300 dots per inch (dpi) while at 600 dpi a page can have 33 million dots compared with the eight hundred thousand pixels on a 1024 by 768 display device such as a computer monitor. The micro electro-mechanical switches are preferably formed in a geometric array pattern and wrapped around a drum to form a rotating assembly. The array may be linear, interdigitated, or some other geometric pattern.

Figure 2:
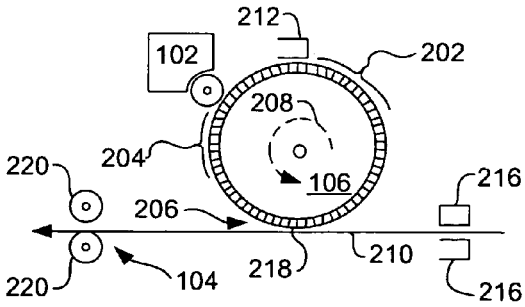
FIG. 2 is a detailed illustration of the indelible printer system of FIG. 1 in accordance with an embodiment of the present invention.

FIG. 2 illustrates printer 100 in greater detail. Specifically, a portion of printer 100 is illustrated where electrostatic receptor assembly 106 is shown in cross-section having a ring of electro-mechanical switches, such as shown at 202, 204 and 206, with each switch representing a row of such switches that extend into the plane of the paper. It is to be understood that receptor assembly 106 may include several hundred or several thousand such switches in a single row and that the number of switches shown in the cross sectional view may be easily changed by changing the diameter of the drum-like receptor assembly 106. Thus, the width of the paper to be printed is determined by merely providing a selected number of switches in each row. There is no need to adapt any optical components or to slow the printing speed so that a laser could charge a longer photoreceptor. Similarly, the length of the paper to be imaged on receptor assembly 106 is determined by its diameter and the corresponding increase in the number of rows of switches in the array. Alternatively, rather than increasing the diameter of receptor assembly 106, it is possible to continually transfer the charged image to receptor image 106. In this manner, a long sheet of paper, such as a banner could be printed by defining print zones with each zone corresponding to a single revolution of receptor assembly 106.

During operation of printer 100, receptor assembly 106 rotates in counter-clockwise direction as indicted by arrow 208. Preferably, receptor assembly 106 rotates in a direction that is opposite from the direction that the page of paper travels, the direction of which is indicated by arrow 210. Prior to picking up toner, it may be desired to ensure that receptor assembly 106 is clean and substantially free of toner material. A corona wire 212 has a large negative charge so that attracts the positively charged toner from regions of receptor assembly 106. The regions proximate to wire 212 do not have any electrostatic charge. Charge is removed from receptor assembly 106 by setting switches in area 202 to an OFF position.

Once a switch is clean of residual toner, it may be selectively switched to an ON state prior to pass by toner hoper 102. Switches in area 204 will have received toner if they were in the ON state when they passed by hopper 102 and will not receive toner if they were in the OFF state. Since the toner has a positive charge, it clings to the areas of the receptor assembly that have a negative charge (that is areas that have a corresponding switch in the ON state), but not to the positively charged "background" areas.

As receptor assembly 106 continues to rotate, switches, as indicated at 206, will come into proximity of the electrically charged piece of paper or other substrate. With the powder pattern affixed, the drum rolls over a sheet of paper, which is moving along a belt below. Before the paper rolls under the drum, it is given a negative charge by a charge wire or charged roller 216. This charge is stronger than the negative charge of the electrostatic image, so the paper can pull the toner away from receptor assembly 106. Since the paper is moving at the same speed as the receptor assembly, the paper picks up the image pattern exactly.

When the paper is positioned under receptor assembly 106, the charge is removed from the switch at the area indicated at 218 to ensure maximum toner transfer to the paper. This feature is not possible with a photoreceptor based printing system. As the sheet of paper is moved by the paper transport mechanism 104 (FIG. 1) away from receptor assembly 106, a pair of fusing rollers 220 heats the paper and melts the toner into the paper. Toner is specially designed to melt very quickly when fusing rollers 220 apply heat and pressure to the imaged paper so that the toner is permanently adhered to the paper. The receptor assembly 106 is then cleaned of any remnants of toner and the cycle repeats for the next sheet.

Figure 3:
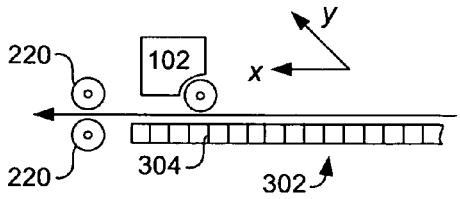
FIG. 3 is another detailed illustration of the indelible printer system of FIG. 1 in accordance with another embodiment of the present invention.

Another embodiment of printer 100 is shown in FIG. 3. Instead of receptor assembly 106 that functions as a charged rotating drum to pick up toner from the hopper and deposit the toner on the paper, this embodiment utilizes a flat plate 302 containing a plurality of rows of micro electro-mechanical switches such as row 304. Each row of switches may contain any number of micro electro-mechanical switches so that a wide range of paper sizes can be readily printed. Further, plate 302 may contain any number of rows of micro electro-mechanical switches so that any desired length of paper can be accommodated.

In one illustrative embodiment, plate 302 comprises at least 33 million switches so that a sheet of A4 size paper can be imaged with 600 dpi resolution. In another embodiment, a lower resolution printer is provided by using a plate 302 that has eight million switches to provide 300 dpi resolution. In yet another embodiment, the switches are controlled so that various colors of toner are deposited on adjacent switches to provide a printed color image. For example, one color of toner may be cyan, another color of toner may be yellow and the third color may be magenta.

In operation, a sheet of lightly charged paper is positioned over plate 302 and each of the plurality of micro electro-mechanical switches in the array is electronically driven to either an OFF state or an ON state. Then, as hopper 102 translates across the sheet of paper and the underlying switches, toner is attracted from hopper 102 toward the sheet of paper wherever the underlying switch is ON. If the switch is OFF, no toner will be applied to the paper. Once hopper 102 has passed over the paper, the paper is moved through fusing rollers 220 to fuse the toner to the paper. In this embodiment, hopper 102 may have the same width as plate 302, in which case it translates only in the "x" direction as indicted by arrow 304 when depositing toner. As the printed sheet of paper is moved past the fusing rollers, hopper 102 is repositioned to an initial position as a new unprinted sheet of paper is moved into position over plate 302.

In another embodiment hopper 102 has a fixed width but it may translate in both an "x" direction and a "y" direction to distribute toner over the paper. Such X-Y plotter mechanisms are well known. In yet another embodiment, multiple hoppers (not shown) are provided with each hopper having a different color of toner. In this embodiment, a sheet of paper is positioned and then only switches that are associated with one of the hoppers are selected and set to either an ON or OFF position as that hopper translates across the paper. All non-selected switches remain in the OFF position so that no toner will be deposited. In yet another embodiment, multiple hoppers are provided, one each for cyan, magenta, yellow and black toners by way of example, and all switches are selected and set to either an ON or OFF position as each hopper sequentially translates across the sheet of paper.

Figure 4A:
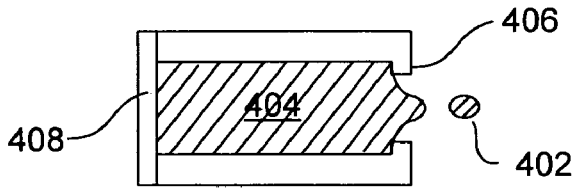
FIGS. 4A and 4B shows another printer based on impulse ink jet technology in accordance with an embodiment of the present invention is illustrated.
Figure 4B:
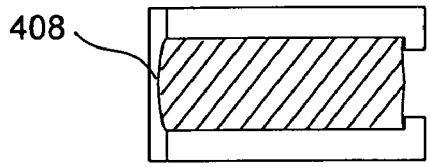

Refer now to FIGS. 4A and 4B where another printer in accordance with an embodiment of the present invention is illustrated. Printer system 400 is a printer that is based on impulse ink jet technology where droplets of ink 402 are produced by a rapid pressure pulse created in a cavity or manifold 404 that contains the ink. The expulsion of an ink droplet through an orifice plate 406 is caused by a rapid small change in the volume of manifold 404 behind the orifice plate 406. Preferably, a micro electro-mechanical switch 408 creates the change in volume by creating a pressure pulse that causes the ejection of the droplets from the orifice plate.

After the ink drop is ejected, switch 408 flexes in the opposite direction, as illustrated in FIG. 4B, to briefly enlarge the volume of the manifold to draw in more ink into the chamber at which time the switch is released and switch 408 snaps back to its rest state or rest configuration. The snap back creates the pressure pulse that ejects the droplet. The flexure of switch 408 as it is switched from an OFF state to an ON state and back to an OFF state is a critical feature. Upon observation of FIG. 4B, it will be apparent that the micro electromechanical switch is in the ON state as ink is filling the cavity.

Use of micro electro-mechanical switches in a printer application is one of the novel features of the present invention contribute to reducing the cost of the various embodiments of the present invention. Micro electro-mechanical switches that can be printed on flexible substrate are described in U.S. patent application Ser. No. 10/959,604, filed on Oct. 5, 2004, the disclosure of which is incorporated herein by reference.

The 60/532,234 application describes a multi-membrane plastic structure on which is patterned row and column drivers to form the matrix of electromechanical micro switches that can be manufactured using low cost printing techniques. The matrix of switches may be flexed or twisted into novel shapes such as the shape of a drum. Each switch 500 in the matrix of switches comprise a plastic membrane 502 on which is printed a plurality of column electrodes 504.

Figure 6:
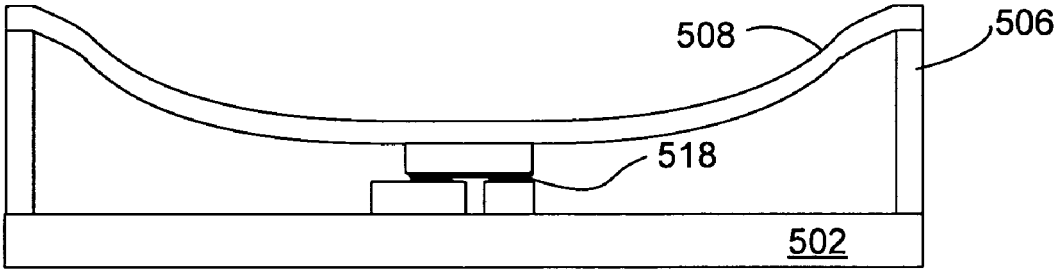
FIG. 6 is a sectional side view of an exemplary cell of an exemplary micro-electromechanical switch in an ON state in accordance with an embodiment of the present invention.

The mechanism of the switch activation involves the electrostatic deflection of flexible membrane 508 such as is illustrated in FIG. 6. Membrane 508 deflects in response to electrostatic voltages applied to electrode contacts 512 and electrode 514 until contacts 512 and 514 are in both mechanical and electrical contact. Upon contact, a latching contact 516 of latching electrode 518 also makes mechanical and electrical contact with contact 512. Electrodes 510 and 518 comprises a "latching" mechanism such that once closed and latching contact 516 is energized, the switch will remain in a closed state until instructed to release.

For each embodiment of this invention, it is desired to have the switch quickly change from an ON (or closed) state to an OFF (or open) state. Since switch 500 comprises a substantially sealed cell, the force that causes the switch to open is a combination of both an elastic force caused by the deformation of membrane 508 and a pneumatic force caused by the volumetric compression of the atmosphere with the cell. The selection of appropriate materials for the flexible membrane allows one, linear, degree of freedom in determining how quickly the switch will open. Treating the cell as a pneumatic device, another completely different degree of freedom is added to the switch design. Pneumatic devices exhibit different behavior in response to deflection of the flexible membrane, and this behavior can be very non-linear in nature. Boyle's Law defines the relationship of pressure, P, and volume, V, for these devices as:

$$PV=nRT$$

With "n" being the number of moles of gas, R the Universal Gas Constant, and T the temperature in degrees Kelvin.

The cell can be defined by its volume at rest and the amount of volume change allowed by the flexibility of the membrane and the interior cell configuration. For simplicity, the behavior of the flexible membrane can be characterized at three points in the deflection of the membrane film, specifically switch open, initial switch contact and latched switch contact.

Figure 5:
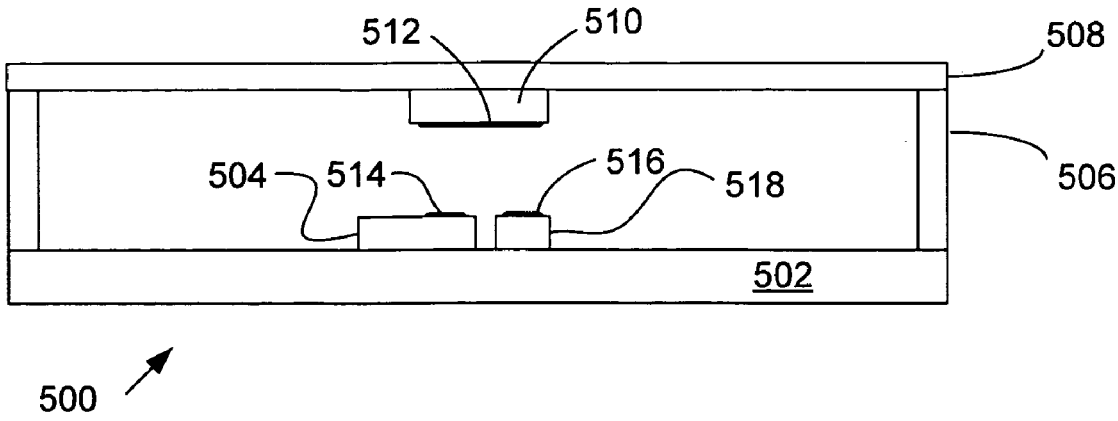
FIG. 5 is a sectional side view of an exemplary cell of an exemplary micro-electromechanical switch in an OFF state in accordance with an embodiment of the present invention.

As most clearly seen in FIG. 5, spacer layer 506 defines the gas volume of switch 500. When switch 500 is open, membrane 508 is not deflected and only minor residual film stress, gravitational effects, environmental shock effects or barometric variations will cause any variation in cell volume. The volume of the cell will be defined as V0 when in the OFF state. When address voltages are applied, membrane 508 will deflect far such that electrical contact between electrodes is made. When this occurs, the volume will be defined as VA. When latched, membrane 508 is pulled a bit closer toward membrane 502 because of the attractive force created by the high latch voltage and cell volume is further reduced to VL.

Figure 7:
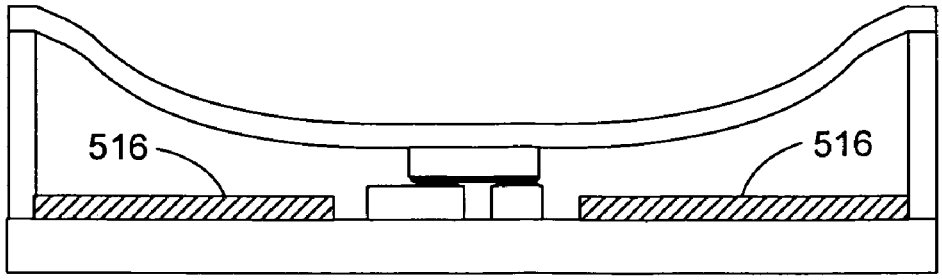
FIGS. 7–9 illustrate various levels of packing of the interior of a switch in accordance with an embodiment of the present invention.
Figure 8:
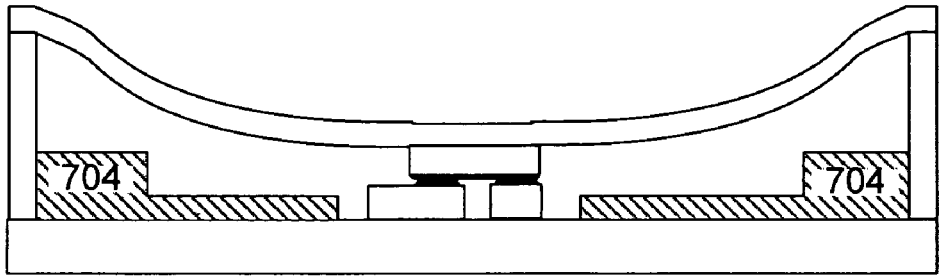
Figure 9:
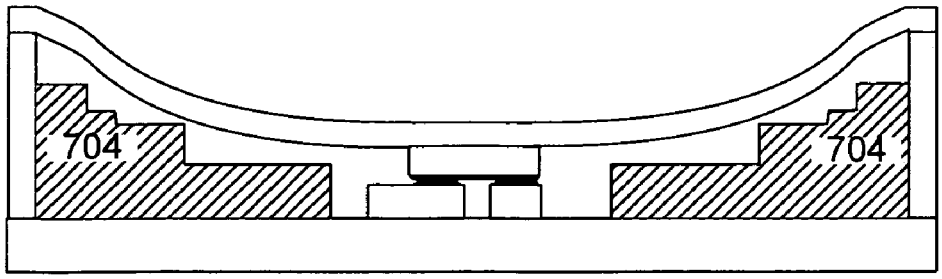

In the absence of any intentional perforations in the membranes, an increase in gas pressure occurs as the volume of switch 500 changes from V0 to VA to VL. However, by altering volume V0 by "packing" the gas volume defined by VL. Packing involves replacing the gas volume VL with a material that is substantially incompressible such as is illustrated in FIGS. 7–9. The packing material may be photo resist, silicon oxide, epoxy or any other materials that is flexible and not subject to cracking or spalling. In FIG. 7, minimal packing 702 is employed while FIGS. 8 and 9 utilize additional packing 704 is provided with most of the additional packing tending to be positioned primarily proximate to spacer layer 506. It should be noted that over-packing the switch may lead to failure to contact or even over pressurization sufficient to perforate the flexible membrane, and for ones skilled in the art this constraint will be appreciated.

Figure 10:
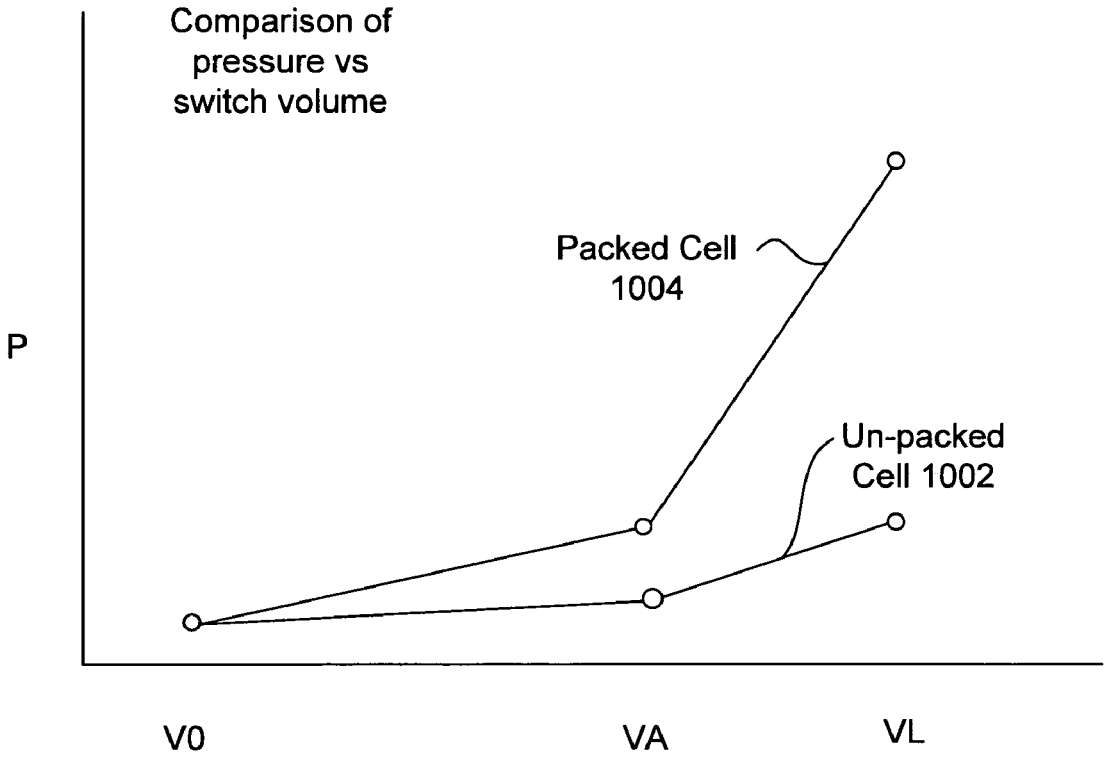
FIG. 10 is a diagram that illustrates the effect of packing the cell of a switch in accordance with an embodiment of the present invention.

The effect of packing on the pressure within the cell as the flexible film is deflected is illustrated in FIG. 10 with the pressure rise of the packed example in going from V0 to VL being significantly increased. The change of pressure necessary to close the switch contacts is best if it is not excessive, while the pressure rise from switch contact to latch contact is best if it is large and able to help to break the contact when appropriate. By packing the switch volume, both of these effects can be made to happen and used to improve the reliability of the switch.

As seen by comparing the non-linear response of the pressure with volume change for an unpacked cell 1002 to a packed cell 1004 shows that it is possible to tailor the pressure build up. Thus, when going from V0 to VA and from VA to VL it is possible to customize the cell such that low electrostatic power is needed to create the initial switch contact and a high pressure is generated when the latch contact is made. This boost in pressure from VA to VL means that the elasticity of the film is not the only restoring force when it comes time for the contact to break.

Accordingly, the micro electro-mechanical switch may be used to generate an electrostatic region on a drum, plate or used as the actuator that generates a drop on demand in an ink jet printer. Rapid switching is achieved by packing the cell of each switch to ensure rapid return from a closed position to an open position. Switches 500 act as a charged receptor when in the ON or closed state to attract electrically charged toner in the shape of the image that is then transferred onto a sheet of paper. Advantageously, the switches may be printed on flexible substrates and formed in the shape of a drum, or similar geometric shape. Each switch corresponds to a dot and may be determined electrically. Further, the switch can be used in place of the piezo-electric crystal to generate the shock wave that expels a drop of ink on demand.

Although the invention has been described with respect to specific embodiments thereof, these embodiments are merely illustrative, and not restrictive of the invention. In the description herein, numerous specific details are provided, such as examples of components and/or methods, to provide a thorough understanding of embodiments of the present invention. One skilled in the relevant art will recognize, however, that an embodiment of the invention can be practiced without one or more of the specific details, or with other apparatus, systems, assemblies, methods, components, materials, parts, and/or the like. In other instances, well-known structures, materials, or operations are not specifically shown or described in detail to avoid obscuring aspects of embodiments of the present invention.

Reference throughout this specification to "one embodiment," "an embodiment," or "a specific embodiment" means that a particular feature, structure, or characteristic described in connection with the embodiment is included in at least one embodiment of the present invention and not necessarily in all embodiments. Thus, respective appearances of the phrases "in one embodiment," "in an embodiment," or "in a specific embodiment" in various places throughout this specification are not necessarily referring to the same embodiment. Furthermore, the particular features, structures, or characteristics of any specific embodiment of the present invention may be combined in any suitable manner with one or more other embodiments. It is to be understood that other variations and modifications of the embodiments of the present invention described and illustrated herein are possible in light of the teachings herein and are to be considered as part of the spirit and scope of the present invention.

It will also be appreciated that one or more of the elements depicted in the drawings/figures can also be implemented in a more separated or integrated manner, or even removed or rendered as inoperable in certain cases, as is useful in accordance with a particular application. It is also within the spirit and scope of the present invention to implement a program or code that can be stored in a machine-readable medium to permit a computer to perform any of the methods described above.

Additionally, any signal arrows in the drawings/Figures should be considered only as exemplary, and not limiting, unless otherwise specifically noted. Furthermore, the term "or" as used herein is generally intended to mean "and/or" unless otherwise indicated. Combinations of components or steps will also be considered as being noted, where terminology is foreseen as rendering the ability to separate or combine is unclear.

As used in the description herein and throughout the claims that follow, "a," "an," and "the" includes plural references unless the context clearly dictates otherwise.

Also, as used in the description herein and throughout the claims that follow, the meaning of "in" includes "in" and "on" unless the context clearly dictates otherwise.

The foregoing description of illustrated embodiments of the present invention, including what is described in the Abstract, is not intended to be exhaustive or to limit the invention to the precise forms disclosed herein. While specific embodiments of, and examples for, the invention are described herein for illustrative purposes only, various equivalent modifications are possible within the spirit and scope of the present invention, as those skilled in the relevant art will recognize and appreciate. As indicated, these modifications may be made to the present invention in light of the foregoing description of illustrated embodiments of the present invention and are to be included within the spirit and scope of the present invention.

Thus, while the present invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the present invention. It is intended that the invention not be limited to the particular terms used in following claims and/or to the particular embodiment disclosed as the best mode contemplated for carrying out this invention, but that the invention will include any and all embodiments and equivalents falling within the scope of the appended claims.

What is claimed is:

1. A printer system comprising:

a hopper for distributing electrically charged toner;

a paper transport mechanism for positioning paper proximate to said hopper and for moving said paper to an output tray;

an electrostatic receptor assembly for defining dots on said paper that are to receive and for transferring said toner to said paper; and means for fusing said toner to said paper as said paper transport moves said paper to an output tray.

2. The printer system of claim 1 wherein said electrostatic receptor assembly comprises a plurality of switches that selectively generate an electric field, said electric field having sufficient strength to attract said electrically charged toner.

3. The printer system of claim 2 wherein said plurality of switches is operated to transfer electrically charged toner to selected dots on said paper.

4. The printer system of claim 2 wherein each of said plurality of switches corresponds to a dot on said paper and selected switches of said plurality of switches are electrically energized when proximate to said hopper and electrically de-energized when said switches are aligned with corresponding dots on said paper.

5. The printer system of claim 1 wherein said electrostatic receptor assembly comprises a plurality of micro electromechanical switches configured in the shape of a drum.

6. The printer system of claim 5 wherein each of said switches corresponds to a dot on said paper.

7. The printer system of claim 6 further comprising a plurality of hoppers, each of said hoppers containing a different color of electrically charged toner that sequentially distribute toner to selected ones of said switches.

8. The printer system of claim 5 wherein a group of at least three switches corresponds to a common dot on said paper.

9. The printer system of claim 7 further comprising a plurality of hoppers, each of said hoppers containing a different color of electrically charged toner whereby said hoppers distribute toner to selected switches within said plurality of said switches.

10. The printer system of claim 1 wherein said electrostatic receptor assembly comprises a plurality of micro electromechanical switches configured as a flat plate.

11. The printer system of claim 10 wherein transport system positions said paper between said hopper and said electrostatic receptor assembly.

12. The printer system of claim 10 wherein each of said switches corresponds to a dot on said paper.

13. The printer system of claim 12 further comprising a plurality of hoppers, each of said hoppers containing a different color of electrically charged toner that sequentially distribute toner to selected ones of said switches.

14. The printer system of claim 10 wherein a group of at least three switches corresponds to a common dot on said paper.

15. The printer system of claim 14 further comprising a plurality of hoppers, each of said hoppers containing a different color of electrically charged toner whereby said hoppers distribute toner to selected switches within said group of switches.

16. A printer system comprising:

a hopper for distributing electrically charged toner;

a paper transport mechanism for positioning paper proximate to said hopper and for moving said paper to an output tray;

an electrostatic receptor assembly comprising a plurality of micro electromechanical switches, each of which define a dot on said paper, said switches electrically controllable to transfer toner from said hopper to a corresponding dot on said paper; and means for fusing said toner to said paper as said paper transport moves said paper to an output tray.

17. The printer system of claim 16 wherein said switches are packed with a substantially incompressible material.

18. The printer system of claim 16 wherein said switches are configured as a sheet of switches rolled into a drum-like shape and said drum transfers toner from said hopper to said paper.

19. The printer system of claim 16 wherein said switches are configured as a sheet of switches and said paper is interposed between said hopper and said sheet of switches.

20. The printer system of claim 16 wherein said switch is packed with a substantially incompressible material.

* * * * *